United States Patent [19]

Nigorikawa et al.

[11] Patent Number: 4,990,482

[45] Date of Patent: Feb. 5, 1991

[54] HEAT-SENSITIVE RECORDING MATERIAL

[75] Inventors: Kazunori Nigorikawa; Masato Satomura; Mitsuyuki Tsurumi, all of Shizuoka, Japan

[73] Assignee: Fuji Photo Film Co., Ltd., Kanagawa, Japan

[21] Appl. No.: 325,829

[22] Filed: Mar. 20, 1989

[30] Foreign Application Priority Data

Mar. 18, 1988 [JP] Japan ..... 63-64971

[51] Int. Cl.[5] ..... B41M 5/18

[52] U.S. Cl. ..... 503/209; 427/150; 503/215; 503/216; 503/221; 503/225

[58] Field of Search ..... 427/150–152; 503/216, 221, 225

[56] References Cited

U.S. PATENT DOCUMENTS 4,628,335 12/1986 Igarashi et al. ..... 503/208

4,682,193 7/1987 Iwakura et al. ..... 503/209

FOREIGN PATENT DOCUMENTS 2292477 12/1987 Japan ..... 503/216

*Primary Examiner*—Bruce H. Hess

*Attorney, Agent, or Firm*—Sughrue, Mion, Zinn, Macpeak & Seas

[57] ABSTRACT

A heat-sensitive recording material is disclosed, which comprises a support having provided thereon a transparent heat-sensitive layer comprising color former-containing microcapsules and at least one color developer, wherein the color developer contains a compound represented by formula (I):

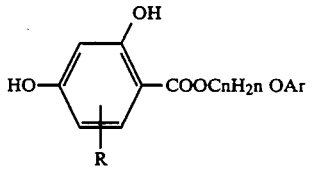

(I)

wherein R represents a hydrogen atom, a halogen atom, an alkoxy group, an alkyl group, or a phenyl group; Ar represents a substituted or unsubstituted aryl group; and n is an integer of from 2 to 10.

The heat-sensitive recording material provides a heat-sensitive layer having high sensitivity and good transparency.

12 Claims, No Drawings

HEAT-SENSITIVE RECORDING MATERIAL

FIELD OF THE INVENTION

The present invention relates to a heat-sensitive recording material comprising a support having provided thereon a heat-sensitive layer. More particularly, the present invention relates to a heat-sensitive recording material comprising a heat sensitive layer of excellent transparency.

BACKGROUND OF THE INVENTION

The heat-sensitive recording method has the following advantages:

(1) Developing is not required;

(2) When the support is a paper sheet, the quality of the paper may be near that of conventional paper;

(3) Handling of the product is easy;

(4) Coloring density is high;

(5) The recording device is simple and cheap;

(6) There is such an advantage that no noise is generated in the time of recording; and the like.

Due to such advantages, in recent years the heat-sensitive recording method has been used widely in the fields of facsimile and printers.

Under such a background as described above, there is a need for developing a heat-sensitive recording material of improved transparency, which can be directly used for recording with a thermal head, including multicolor process application, or to be used in an over-head projector (abridged as OHP).

However, the conventional transparent heat-sensitive recording material is a so-called transparent heat-sensitive film, which is brought into close contact with a manuscript and then irradiated with light to let the image part of the manuscript absorb infra-red rays, whereby the temperature of the image part is raised, causing corresponding parts of the heat-sensitive recording film to be colored. Therefore, it does not have such heat sensitivity for direct recording with a thermal head as used in a facsimile or the like.

Also, the type of heat-sensitive layer of the heat-sensitive recording material adapted for thermal recording with a thermal head becomes devitrified, so the desired transparency could not be obtained.

The present inventors have developed a novel transparent heat-sensitive material which overcomes the defects of conventional heat-sensitive recording materials. The basic heat-sensitive system used is a combination of a colorless or pale colored base dye precursor (color former) and a color developer as the color-forming system. This type of system is described in JP-A-63-265682 (the term "JP-A" as used herein refers to an "unexamined published Japanese patent application"). According to that document, a transparent heat-sensitive recording material can be obtained by a process comprising the steps of introducing the base dye precursor into microcapsules, dissolving the color developer into an organic solvent difficultly soluble or insoluble in water, emulsifying and dispersing in a water phase the color developer dissolution product, mixing the base dye precursor-containing microcapsules with the dispersion and then coating the mixture on a support.

However, it was found that the transparency of the above-described heat-sensitive recording material depends markedly on the emulsion stability of the color developer of the heat-sensitive layer. For example, when p-hydroxy benzoic acid benzyl ester, which is known as a color developer of high sensitivity in a heat-sensitive recording material, was used, it was liable to crystallize out and to be fogged, thereby adversely affecting transparency.

SUMMARY OF THE INVENTION

Therefore, an object of the present invention is to provide a heat-sensitive recording material having a transparent heat-sensitive layer which has high sensitivity, good transparency and which can be used in OHP.

The object of the present invention has been attained by providing a heat-sensitive recording material which comprises a support having provided thereon a transparent heat-sensitive layer comprising color former-containing microcapsules and at least one color developer, wherein the at least one color developer contains a compound represented by general formula (I):

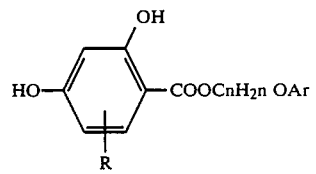

(I)

wherein R represents a hydrogen atom, a halogen atom, an alkoxy group (having preferably 1 to 4 carbon atoms), an alkyl group (having preferably 1 to 4 carbon atoms) or a phenyl group; Ar represents a substituted or unsubstituted aryl group, and n is an integer of from 2 to 10.

DETAILED DESCRIPTION OF THE INVENTION

The substituted or unsubstituted aryl group represented by Ar in formula (I) is preferably represented by the following formula (II):

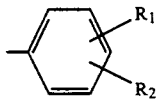

(II)

wherein $R_1$ and $R_2$, which may be the same or different, each represents a hydrogen atom, a halogen atom, an alkyl group, an alkoxy group, an aryl group, an aralkyl group, or an allyl group. When $R_1$ or $R_2$ represents an alkyl, alkoxy, aryl or aralkyl group, the carbon number is preferably 1 to 10.

Specific examples of the group represented by formula (II) are shown below.

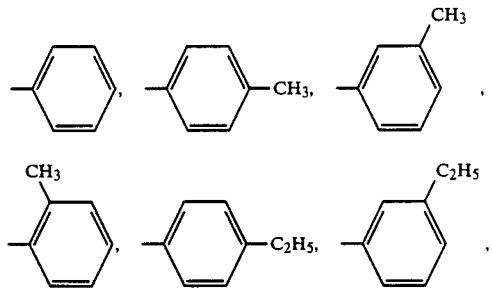

-continued

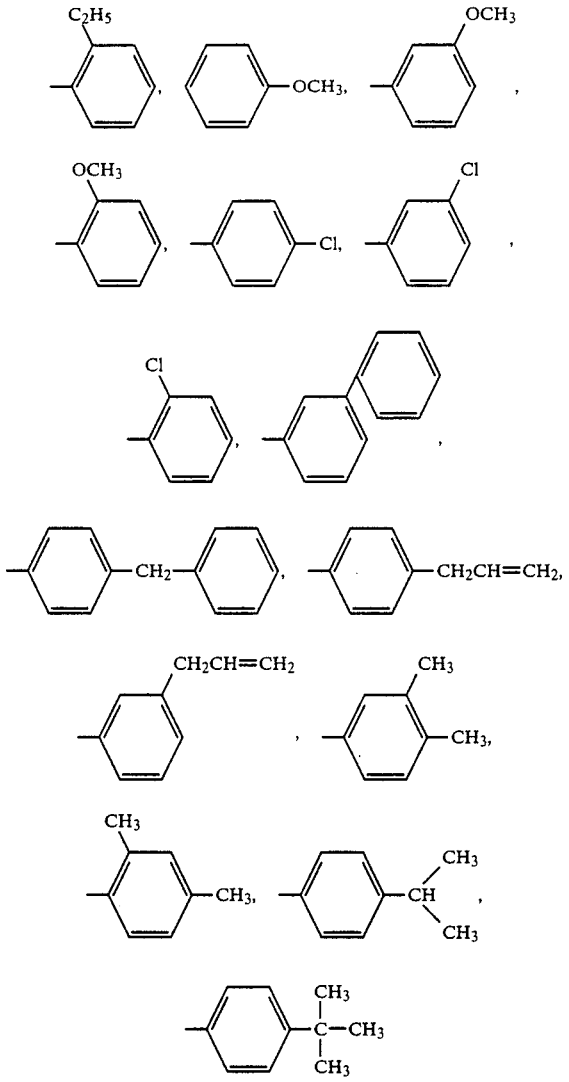

In formula (I), n preferably is an integer of from 2 to 8, and especially preferable examples of the moiety $-C_nH_{2n}-$ are shown below.

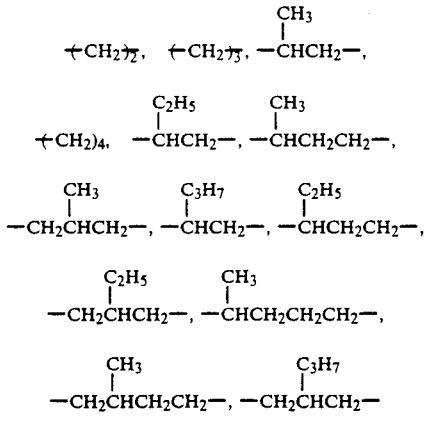

In formula (I), R preferably represents a hydrogen atom, a halogen atom, or an alkyl group. Preferred examples of the moiety

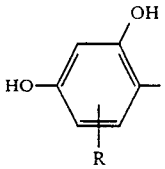

of formula (I) are shown below.

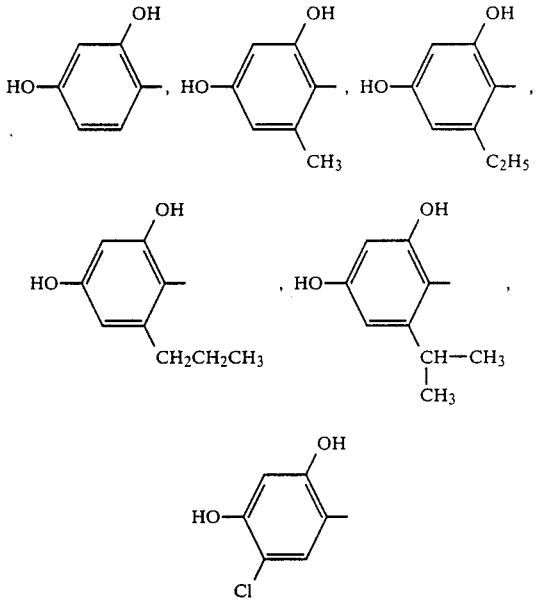

As to the above-described compounds of formula (I), various methods of synthesis can be considered, but in the present invention, the objective compounds can be obtained by heating a resorcinic acid and the tosylate of a corresponding alcohol under the presence of a base.

Specific examples of the base include sodium hydroxide, potassium hydroxide, or the like. The reaction solvents used include acetone, dimethyl formamide, dimethyl acetoamide, or the like. The reaction is carried out at a temperature in the range from room temperature to 150° C. for 1 to 20 hours.

The tosylate is used in an amount of from 0.5 to 4 mols per mol of the resorcinic acid used and the base is used in an amount of from 1 to 2 mols per mol of the tosylate used.

A synthesis example of the compounds represented by formula (I) is shown below.

SYNTHESIS EXAMPLE

In a 500 cc three neck flask were put 15 g of 2,4-dihydroxy benzoic acid, 34 g of the tosylate of 1-phenoxy2-propanol, 7 g of potassium hydroxide, and 150 cc of dimethyl formamide, and the mixture was stirred for 4 hours. Then, the reaction product was poured into water, and after extracting with ethyl acetate, the solvent was distilled off to yield the resorcinic acid ester. The thus obtained ester was crystallized out in a mixed solvent of benzene and hexane (volume ratio of 1:5) to obtain a crystalline product. The melting point of this crystal was 84–86° C., and from the results of analysis on MS and NMR, it was ascertained that the product was the object 1-phenoxy-2-propyl ester of 2,4-dihydroxybenzoic acid.

Next, explanation will be given on the color former which gives a colored material by contact with the above-described developer.

As the color formers used in the present invention are appropriately selected colorless or pale-colored ones from the known compounds which are colored by donating electrons or accepting protons from acid. Such compounds have the partial skeleton of lactone, lactam, sultone, spiropyrane, ester, amide, or the like, and these partial skeletons are ring opened or are cleaved when contacted to the color developer. Preferred examples of the color formers include triaryl methane compounds, diphenyl methane compounds, xanthene compounds, thiazine compounds, spiropyrane compounds and the like.

Especially preferred compounds are those which can be represented by the following general formula (III):

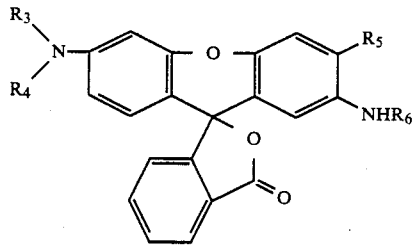

(III)

wherein $R_3$ represents an alkyl group having 1 to 8 carbon atoms, $R_4$ represents an alkyl or alkoxyalkyl group having 4 to 18 carbon atoms, or a tetrahydrofurfuryl group, $R_5$ represents a hydrogen atom, an alkyl group having 1 to 15 carbon atoms, or a halogen atom, and $R_6$ represents a substituted or unsubstituted aryl group having 6 to 20 carbon atoms. As the substituted group for $R_6$, an alkyl, alkoxy, and halogen-substituted alkyl group having 1 to 5 carbon atoms and a halogen atom are preferable.

In the present invention, by incorporating the above-described color former in microcapsules, the fogging of the heat-sensitive material during the time of production can be prevented, and the fresh preservability and recording preservability of the heat-sensitive material are good. In this case, by selecting the wall-forming material and the production method for forming the microcapsules, high picture image density in the time of recording can be obtained. The amount of the color former used is preferably from 0.05 to 5.0 g/m$^2$.

As the wall-forming material of the microcapsules, there can be mentioned polyurethanes, polyureas, polyesters, polycarbonates, urea-formaldehyde resins, melamine resins, polystyrenes, styrene-methacrylate copolymers, styrene-acrylate copolymers, gelatins, polyvinyl pyrrolidones, polyvinyl alcohols, etc. In the present invention, two kinds or more of these high molecular weight substances can be used together.

In the present invention, among the above-described high molecular weight substances, polyurethane, polyurea, polyamide, polyester, polycarbonate, etc. are preferable, and especially, polyurethane and polyurea are preferable.

The microcapsules used in the present invention are preferably made in such a manner that, after emulsifying a core substance containing a reactive substance such as a color former or the like, a wall of high molecular weight substance is formed around the oil drops thereof to make microcapsule particles, and in this case, the reactant for forming the high molecular weight substance is added in the interior of the oil drops and/or in the outside of the oil drops. Detailed information as to the microcapsules, which can be preferably used in the present invention, including a preferable production method of microcapsules and the like are described, for example, in JP-A-59-222716.

As an organic solvent for forming oil drops, appropriate ones can be selected from the ones usually used as a pressure-sensitive oil. Among such ones, the compounds represented by the following general formulae (IV) to (VI), triaryl methanes (for example, tritoluyl methane, toluyldiphenyl methane), terphenyl compounds (for example, terphenyl), alkyl diphenyl ethers (for example, propyldiphenyl ether), hydrogenated terphenyls (for example, hexahydroterphenyl), diphenyl ethers, and chlorinated paraffins are preferably used.

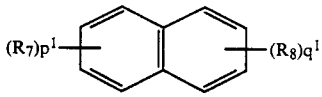

(IV)

In formula (IV), $R_7$ represents a hydrogen atom or an alkyl group having 1 to 18 carbon atoms, $R_8$ represents an alkyl group having 1 to 18 carbon atoms and $p^1$ and $q^1$ each is an integer of 1 to 4 provided that the sum of alkyl groups in the formula is not more than 4.

As the alkyl groups for $R^1$ and $R^2$, the alkyl groups having 1 to 8 carbon atoms are preferable.

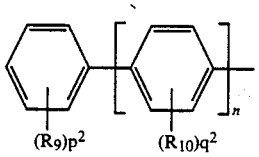

(V)

In formula (V), $R_9$ represents a hydrogen atom or an alkyl group having 1 to 12 carbon atoms, $R_{10}$ represents an alkyl group having 1 to 12 carbon atoms, n is 1 or 2, and $p^2$ and $q^2$ each represents an integer of 1 to 4, provided that when n is 1, the total number of alkyl groups in formula (V) is not more than 4, and when n is 2, the total number of alkyl groups is not more than 6.

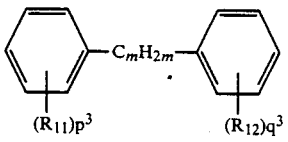

(VI)

In formula (VI), $R_{11}$ and $R_{12}$, which may be the same or different, each represents a hydrogen atom or an alkyl group having 1 to 18 carbon atoms, m represents an integer of 1 to 13, and $p^3$ and $q^3$ each represents an integer of 1 to 3, provided that the total number of alkyl groups in formula (VI) is not more than 3.

Further, as the alkyl groups of $R_{11}$ and $R_{12}$, the alkyl groups having 2 to 4 carbon atoms are especially preferable.

Specific examples of the compounds represented by formula (IV) include dimethyl naphthalene, diethyl naphthalene, and diisopropyl naphthalene.

Specific examples of the compounds represented by formula (V) include dimethyl biphenyl, diethyl biphenyl, diisopropyl biphenyl, and diisobutyl biphenyl.

Specific examples of the compounds represented by formula (VI) include 1-methyl-1-dimethylphenyl-1-phenyl methane, 1-ethyl-1-dimethylphenyl-1-phenyl methane, and 1-propyl-1-dimethylphenyl-1-phenyl methane.

The use of the above-described oils in combination with each other, or with other oils is also possible.

In the present invention, the size of the microcapsule is preferably 4 μm or less as a volume-average particle size according to the measurement method described, for example, in U.S. Pat. No. 4,598,035.

The reactive substances contained in the core and outside of the preferred microcapsules produced by the above-described production method react with each other by passing through the walls of microcapsules.

In the present invention, by appropriately selecting the wall-forming material of the microcapsules, and by modifying if required by adding an adjusting agent for the glass transition temperature of the wall forming material (for example, the plasticizer described in JP-A61-277490), microcapsules comprising a wall having a different glass transition point are prepared, and by selecting a combination of the basic colorless dye precursors having different color phases and color developers, a multicolored intermediate color can be realized. Therefore, the present invention is not limited to the mono-colored heat-sensitive paper only, but can be applied also to double colored or multi-colored heat-sensitive paper and heat-sensitive paper suitable for picture image recording having gradation properties.

Also, in correspondence to needs, it is possible to add an optical fading preventing agent as described in JP-A-61-283589, JP-A-61-283590 and JP-A-61-283591.

The color developer for effecting coloring reaction, during thermal application, of the basic colorless dye used in the present invention, other than the above-described compounds of the formula (I), can include the compounds selected from known ones. For example, as a color developer for a leuco dye, there can be mentioned a phenol compound, a triphenyl methane compound, a sulfur-containing phenol compound, a carboxylic acid compound, a sulfone compound, a urea or thiourea compound, etc. Detailed information thereof is described in *Paper Pulp Technical Times*, published by Tectimes Inc. (1985) pages 49 to 54 and pages 65 to 70. Among these compounds, those having a melting point of 50° C. to 250° C. are especially preferred, and above all, the phenol and organic acid difficulty soluble in water at 60° C. to 200° C. are preferable. In the case when two or more kinds of the developers are used together, often the solubility to the organic solvents increases and a favorable effect can be obtained.

The especially preferred ones among the color developers usable in the present invention can be represented by the following general formulae (VII) to (X):

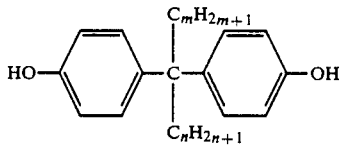

(VII)

wherein m is an integer of from 0 to 2, and n is an integer of from 2 to 11;

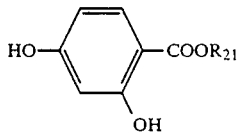

(VIII)

wherein $R_{21}$ represents an alkyl group, an aryl group or an aralkyl group, and especially preferred is when $R_{21}$ is a methyl group, an ethyl group or a butyl group;

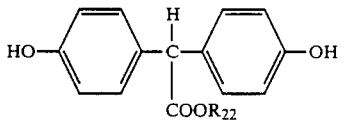

(IX)

wherein $R_{22}$ is an alkyl group; and especially, a butyl group, a pentyl group, a heptyl group, and an octyl group are preferred for $R_{22}$;

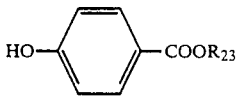

(X)

wherein $R_{23}$ is an alkyl group or an aralkyl group.

When the above-described known color developers are used in the heat-sensitive recording material of the present invention, it is preferred that the weight ratio of the amount of color developer to that of compound of formula (I) in the recording material is 20:1 to 1:4.

Further, it is preferred that 3 to 15% of the heat-sensitive layer is occupied by the compound of formula (I).

In the present invention, after dissolving a color developer in an organic solvent difficultly soluble or insoluble in water, the resultant solution is mixed with a water phase containing a surfactant and a water-soluble high molecular weight protective colloid to provide an emulsified dispersion for use in the invention.

The organic solvent for dissolving a color developer can be appropriately selected from organic solvents difficultly soluble or insoluble in water. Especially, the organic solvents having a boiling point of 150° C. or less show good thermal sensitivity and are preferably used. As such organic solvents there can be mentioned, for example, ethyl acetate, isopropyl acetate, butyl acetate, methylene chloride, etc.

In the present invention, although the esters of high boiling point, or the above-described pressure-sensitive oils can be used together with the organic solvents having a boiling point of 150° C. or less, from the view point of the stability of the emulsified dispersion of the color developer, the use of esters of high boiling point is preferred.

As the preferred esters having high boiling point, there can be mentioned phosphoric acid esters, (for example, triphenyl phosphate, tricresyl phosphate, butyl phosphate, octyl phosphate, and cresyldiphenyl phosphate), phthalic acid esters (dibutyl phthalate, 2-ethylhexyl phthalate, ethyl phthalate, octyl phthalate, tetrahydrodioctyl phthalate, and butylbenzyl phthalate), benzoic acid esters (ethyl benzoate, propyl benzoate, butyl benzoate, isopentyl benzoate, and benzyl benzoate), abietic acid esters (ethyl abietate, and benzyl abietate), dioctyl adipate, isodecyl succinate, dioctyl azeleinate, oxalic acid esters (dibutyl oxalate, dipentyl oxalate), diethyl malonate, maleic acid esters (dimethyl maleate, diethyl maleate, and dibutyl maleate), tributyl succinate, sorbic acid esters (methyl sorbate, ethyl sorbate, and butyl sorbate), sebacic acid esters (dibutyl sebacate, and dioctyl sebacate), ethyleneglycol esters (formic acid monoester and diester, lactic acid monoester and diester, laulyric acid monoester and diester, palmitic acid monoester and diester, stearic acid monoester and diester, oleic acid monoester and diester), triacetin, diethyl carbonate, diphenyl carbonate, ethylene carbonate, propylene carbonate, boric acid ester (tributyl borate, and tripentyl borate), etc.

The water-soluble high molecular weight substance to be present as a protective colloid in the water phase mixed with the oil-phase containing the dissolved color developer can be appropriately selected from the known anionic, nonionic, and amphoteric high molecular weight protective colloid substances, but the preferred ones are polyvinyl alcohol, gelatin, and cellulose derivatives. Among these, partially saponified products of polyvinyl alcohol are preferred, and those having a saponification degree of 75 to 90% are especially preferred.

Especially, in the case when a partially saponified product of polyvinyl alcohol is used as a protective colloid, although the reason is not clear, the emulsified dispersion of the color developer is stabilized, and as a result, the transparency of the heat-sensitive recording material is extremely good when used in a heat-sensitive recording material. In order to make the effect of this partially saponified product of polyvinyl alcohol most effective, it is preferable to use it in the time of emulsification, but it is also possible to add the partially saponified product of polyvinyl alcohol after emulsifying the sample by another protective colloid.

Also, as a surfactant to be contained in the water phase, the one which acts with the above-described protective colloid to form no precipitation and no coagulation can be appropriately selected from the anionic or nonionic surfactants. As the preferable surfactant, there can be mentioned sodium alkylbenzene sulfonate (for example, sodium dodecylbenzene sulfonate), sodium alkyl sulfates, sulfosuccinic acid dioctyl sodium salt, polyalkylene glycols (for example, polyoxyethylene nonylphenyl ether), etc.

The emulsified dispersion of the color developer containing a partially saponified product of polyvinyl alcohol can be readily obtained by mixing and dispersing the oil phase containing the color developer and the water phase containing another optional protective colloid, the saponification product and a surfactant by using means usually used in the emulsification of fine particles, such as high speed stirring, ultrasonic wave dispersion, or the like.

It is possible to add an appropriate melting point depressant to this emulsified dispersion. In part, such a melting point depressant has the function of the glass transition point regulating agent for the above-described microcapsule wall. As such a compound, there are, for example, the hydroxy compounds, carbamic acid ester compounds, sulfoneamide compounds, aromatic methoxy compounds, etc., and the details thereof are described, for example, in JP-A-61-121990.

These melting point depressants can be appropriately used in an amount of 0.1 to 2 parts by weight per part of the color developer for depressing the melting point, and preferably in an amount of 0.5 to 1 part by weight, but it is preferable that the melting point depressant and the color developer for depressing the melting point thereby are used in the same coating layer. In case when the addition of each is effected in different layers (e.g., adjacent layers), it is preferable to add the depressants in an amount of 1 to 3 times of the above-described range.

The heat-sensitive recording material of the present invention can be coated by using a suitable binder.

As a binder, various kinds of emulsions of polyvinyl alcohol, methyl cellulose, carboxymethyl cellulose, hydroxypropyl cellulose, gum arabic, gelatin, polyvinyl pyrrolidone, casein, styrene-butadiene latex, acrylonitrilebutadiene latex, polyvinyl acetate, polyacrylic acid ester, ethylene-vinylacetate copolymer, etc. be used. The amount of use is 0.5 to 5 g/m$^2$ as a solid content.

The heat-sensitive recording material of the present invention can be produced by producing a coating composition containing microcapsules incorporating a color developer, a dispersion emulsified and dispersed with at least a color developer and containing a partially saponified product of polyvinyl alcohol, and other additives such as a binder and the like, and then, the composition is coated on a support such as a paper sheet or a synthetic resin film by means of a coating method described in the following to provide thereon a heat-sensitive layer of solid content of 2.5 to 25 g/m$^2$. The heat-sensitive layer of the heat-sensitive material produced in such a manner as described above, surprisingly has extremely good transparency (i.e., haze of 20% or less), although the reason is not clearly known.

The transparency involved here as such can be represented by a value of haze (%) measured by an integral spherical method HTR meter made by Nippon Seimitsu Kogyo Co., Ltd. However, the transparency of a practical test sample of the heat-sensitive layer is greatly influenced by light scattering due to the fine unevenness of the surface of the heat-sensitive layer. Therefore, in case when the transparency inherent in the heat-sensitive layer, which is the problem solved by the present invention, i.e. the transparency in the interior of the heat-sensitive layer, is measured with a haze meter, a simple method is adopted to adhere a transparent adhesive tape on the heat-sensitive layer to evaluate the sample by removing the surface scattering effect.

In the heat-sensitive recording material of the present invention, to prevent sticking to a thermal head and to improve writing properties, a pigment such as silica, barium sulfate, titanium oxide, aluminium hydroxide, zinc oxide, calcium carbonate, etc., or fine powder of styrene beads, urea-melamine resin, etc., can be added to the heat-sensitive layer, but, in order to maintain the transparency of the heat-sensitive layer, it is preferable to provide a protective layer for preservability and stability on the heat-sensitive layer by a known method and to add it to this protective layer. Details on the protective layer are described, for example, in the *Paper Pulp Technical Times*, pages 2–4, (Sept., 1985).

Also, in the same way, metal soaps can be added in order to prevent sticking. Amount of use of these is 0.2 to 7 g/m$^2$.

It is advantageous from the viewpoint of the shelf life with the passage of time to use a neutral paper having a heat extraction pH of 6 to 9, which is sized by a neutral sizing agent such as alkylketene dimer, etc., (e.g., JP-A-55-14281) as the paper for the support.

Also, for preventing the permeation of the coating liquid into a paper support and improving the contact with the heat-sensitive recording layer with a thermal recording head, a paper having the ratio $$\frac{\text{stockigt sizing degree}}{(\text{meter weighing capacity})^2} > 3\times10^{-3}$$

and a Bekk smoothness of higher than 90 seconds, as described in JP-A-57-116687 is advantageous.

Furthermore, a paper having the optical surface roughness of 8 microns or less and a thickness of from 40 to 75 microns as described in JP-A58-136492; a paper having a density of 0.9 g/cm$^3$ or less and an optical contact percentage of 15% or more as described in JP-A-58-69091; a paper manufactured from a pulp having a Canadian standard freeness (JIS P8121) of 400 cc or more for preventing the permeation of a coating liquid in the paper as described in JP-A-58-69097; a paper manufactured by Yankee paper machine, where the lustrous surface thereof is used as the coating surface for improving the coloring density and the resolving power as described in JP-A-58-65695; and a paper subjected to a corona discharging treatment for improving the coating aptitude as described in JP-A-59-35985 can be used in this invention with good results.

In case when a transparent support is used in the heat-sensitive material of the present invention, although a transmitted picture image or a reflected picture image can be seen from one side of the transparent support, especially in the latter when the back side of the background part can also be seen through the heat-sensitive material, the picture image becomes unclear; so that, in order to be seen white, a white pigment may be added to the heat-sensitive layer or a layer containing white pigment may be additionally coated. In any case, it is effective to effect such a coating measurement to the outermost layer on the side opposite to the side from where the recording picture image is seen. As the examples of a preferable white pigment, there can be mentioned talc, calcium carbonate, calcium sulfate, magnesium carbonate, magnesium hydroxide, alumina, synthetic silica, titanium oxide, barium sulfate, kaolin, calcium silicate, urea resin, etc. The dispersed particle size is preferably not more than 10 μm.

The transparent support as used herein is a film of a polyester such as polyethylene terephthalate, polybutylene terephthalate, or the like, a film of a cellulose derivative such as cellulose triacetate film or the like, or a polyolefin film such as polystyrene film, polypropylene film, polyethylene film, or the like. These may be used as a single film body or as a laminate of one adhered to one another.

The thickness of the transparent support is 20 to 200 μm, and especially 50 to 100 μm thickness is preferred.

In the present invention, in order to increase the adhering strength between the transparent support and the heat-sensitive layer, a subbing layer may be provided there between. As a raw material of the subbing layer, gelatin, synthetic high molecular latex, nitrocellulose or the like is used. The coating amount of the subbing layer is preferably in the range of 0.1 g/m$^2$ to 2.0 g/m$^2$, and especially preferred is the range of 0.2 g/m$^2$ to 1.0 g/m$^2$. When it is less than 0.1 g/m$^2$, the adhesion between the support and the heat-sensitive layer is not sufficient, and even if it is increased to more than 2.0 g/m$^2$, it is disadvantageous in the cost side since the adhesive power between the support and the heat-sensitive layer has saturated.

Since there is such a case that the picture quality of the heat-sensitive layer deteriorates when the subbing layer swells, because of water contained in the heat-sensitive layer, at the time when the heat-sensitive layer is coated on the subbing layer, the subbing layer is preferably cured by use of a film curing agent.

As the film curing agent capable of being used in the present invention, there can be mentioned the following ones:

1. Active vinyl compounds such as, divinylsulfone-N,N'-ethylene bis(vinylsulfonyl acetamide), 1,3-bis(-vinylsulfonyl)-2-propanol, methylenebismaleimide, 5-acetyl-1,3-diacryloyl-hexahydro-s-triazine, 1,3,5-triacryloyl-hexahydro-s-triazine, and 1,3,5-trivinylsulfonyl-hexahydro-s-triazine.

2. Active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethyl amino)-s-triazine, and N,N'-bis(2-chloroethyl carbamyl) piperazine.

3. Bis(2,3-epoxypropyl)methylpropylammonium p-toluenesulfonic acid salt, 1,4-bis(2', 3'-epoxypropyloxy)-butane, 1,3,5-triglycidylisocyanurate, and 1,3-diglycidyl-5(γ-acetoxy-β-oxypropyl)isocyanurate.

4. Ethylenemimino compounds such as 2,4,6-triethylene-s-triazine, 1,6-hexamethylene-N,N'-bisethylene urea, and bis-β-ethyleneiminoethyl thioether.

5. Methane-sulfonic acid ester compounds such as 1,2-di(methane sulfoneoxy)ethane, 1,4-die(methanesulfoneoxy)butane, and 1,5-di(methanesulfoneoxy) pentane.

6. Carbodiimide compounds such as dichlorohexylcarobdiimide, 1- cyclohexyl-3(3-trimethylaminopropyl)-carbodiimide-p-toluenesulfonic acid salt, and 1-ethyl-3-(3-dimethylaminopropyl)carbodiimide hydrochloric acid salt.

7. Isooxazole compounds such as 2,5-dimethylisooxazole perchloric acid salt, 2-ethyl-5-phenylisooxazole-3'-sulfonate, and 5,5'-(paraphenylene)bis-isooxazole.

8. Inorganic compounds such as chrome alum, chromic acetate, boric acid, and zirconium salt.

9. Dehydrated condensed type peptide reagents such as N-carboethoxy-2-isopropoxy-1,2-dihydroquinoline, and N-(1-morpholinocarboxy)-4-methylpyridinium chloride; active ester compounds such as N,N'-adipoyldioxy-disuccin imide and N,N'-terephthaloyl-dioxydisuccinimide.

10. Isocyanates such as toluene-2,4-diisocyanate, and 1,6-hexamethylenediisocyanate.

Among these, especially preferable are the dialdehydes such as glutaraldehyde, 2,3-dihydroxy-1,4-dioxane, and boric acid.

The addition amount of these film curing agents is in a range from 0.20 wt% to 3.0 wt% to the weight of undercoated raw material, and can be selected suitable to meet the coating method and the desired curing degree.

When the addition amount is less than 0.20 wt%, the curing degree is deficient even if a long time has elapsed, and the under coat layer has the defect of becoming swollen, and conversely, when the addition amount is more than 3.0 wt%, the curing degree advances too much to deteriorate the adhesion of the subbing layer to the support, and the subbing layer has the defect of becoming film-like and is peeled off from the support.

Depending on the nature of the curing agent used, if required, caustic soda may further be added to the subbing reaction liquid to make the pH of the liquid alkaline, or it is also possible to make the pH of the liquid acidic by adding citric acid or the like.

Also, in order to extinguish foam generated in the time of coating, it is also possible to add a defoaming agent to the liquid, or to add an activator in order to make the leveling of the liquid good and to prevent the occurrence of coating stripes.

Also, it is possible to add an antistatic agent, if required. Further, it is desirable to let the surface of the support be subjected to an activation treatment by means of a known method. As the method of activation treatment, there can be used the etching treatment with an acid flame treatment by means of a gas burner, or the corona treatment, glow discharge treatment, etc., can be used, but from the stand point of cost and simplicity, the corona discharge treatment described in U.S. Pat. Nos. 2,715,075, 2,846,727, 3,549,406, and 3,590,107, etc. is most preferred.

The heat-sensitive recording material of the present invention has various manners of use, and of course can be designed for use in OHP. Also, it can be provide heat-sensitive layers able to be directly colored in respectively different colors, or via the above-described protective layer or subbing layer, more than two heat-sensitive layers of this invention on the support. Furthermore, it is also possible to provide one layer selected from the known light-sensitive layers, heat-sensitive layers and light-sensitive heat-sensitive layer, and further, to provide thereon substantially transparent heat-sensitive layer described in the present specification, which known (layer(s) can be colored in color(s) different to that of this layer.

The coating liquid according to the present invention can be coated by a well known coating method, such as, for example, the dip coat method, air knife coat method, curtain coat method, roller coat method, doctor coat method, wire bar coat method, slide coat method, gravure coat method, or an extrusion coat method using a hopper described in U.S. Pat. No. 2,681,294, etc. In correspondence to needs, it is also possible to coat simultaneously in two separate layers by the methods described in U.S. Pat. Nos. 2,761,791, 3,508,947, 2,941,898, and 3,526,528, or in Yuji Harazaki, *Coating Technology*, page 253 (published by Asakura Shoten in 1973). It is possible to select a suitable method corresponding to needs such as the coating amount, coating speed, and the like.

There is no obstacle in appropriately mixing a pigment dispersing agent, viscosity increasing agent, flow variation agent, defoaming agent, mold releasing agent, coloring agent, etc. with the coating liquid used in the present invention in correspondence to needs, so long as the characteristics of the coating liquid are not injured.

According to the present invention, since the emulsion stability of the emulsified dispersion of the color developer is markedly increased, the heat-sensitive recording material having a transparent heat-sensitive layer can be produced with good reproducibility; also, the transparency of the heat-sensitive recording material obtained is extremely good.

In the following, although the present invention will be described in more detail by referring to an Example, the present invention is not limited thereby.

EXAMPLE

Fourteen grams of crystal violet lactone (leuco dye, 60 g of Takenate D-110N (capsule wall material made by Takeda Chemical Industries, Ltd.) and 2 g of Sumisorb 200 (ultra-violet ray absorbing agent made by Sumitomo Chemical Company, Limited) are added to a mixed solvent of 55 g of 1-phenyl-1-xylyl ethane and 55 g of methylene chloride and dissolved. The solution of this leuco dye was mixed with 100 g of 8% polyvinyl alcohol aqueous solution, 40 g of water and 1.4 g of an aqueous solution of 2% sodium salt of sulfo-succinic acid (dispersing aid), and emulsified by Ace homogenizer made by Nippon Seiki Co., Ltd. at 10,000 rpm for 5 minutes. Further, 150 g of water was added, and after letting to react at 40° C. for 3 hours, a capsule liquid of 0.7 micron capsule size was obtained.

Preparation of Emulsified Dispersion of the Color Developer

Each 7 g of the developers (a) and (b) represented by the following structural formulae and 35 g of 2,4-dihydroxy benzoic acid 1-phenoxy-2propyl ester shown in the Synthetic Example, 7 g of tricresyl phosphate, and 3 g of diethyl maleate were dissolved in 38 g of ethyl acetate. The solution of the color developer obtained was mixed with 100 g of the aqueous solution of 8% polyvinyl alcohol (PVA 205 made by Kuraray Co., Ltd.; saponification degree of 87 to 89%), 150g of water and 0.5 g of an aqueous solution of dodecylbenzene sodium sulfonate. The mixture was emulsified by using the Ace homogenizer made by Nippon Seiki Co., Ltd. to be stirred at 10,000 rpm at room temperature for 5 minutes and an emulsified dispersion with the particle size of 0.5 micron was obtained.

Color Developer (a)

Zinc salt of

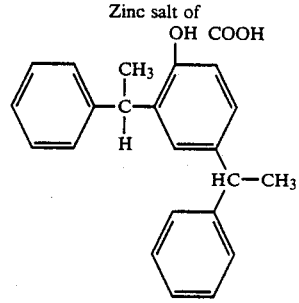

Color Developer (b)

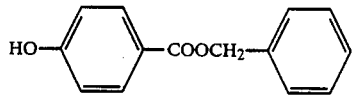

Preparation of Heat-Sensitive Material

A coating liquid was prepared by mixing and stirring 5.0 g of the above-described capsule liquid, 10.0 g of the emulsified dispersion of the color developer, and 5.0 g of water. This coating liquid was left to stand still for one hour and then was coated on a support film so that the film has 5 μm dry thickness to observe the state of the coating liquid. It was ascertained that no defects upon coating such as aggregation occur.

On the other hand, the coating liquid after being left to stand still for one hour was coated on a transparent polyethylene terephthalate (PET) film with thickness of 70 microns to obtain the solid content of 15 g/m$^2$. After drying, the transparency of this film was measured by the integral sphere method HTR meter made by Nippon Seimitsu Kogyo Co., Ltd. Its haze was 8%, with an extremely good transparency. Also, in the coloring of this film on a facsimile machine, a clear concentrated blue color was revealed.

COMPARATIVE EXAMPLE

Instead of the color developer (2,4-dihydroxy benzoic acid-1-phenoxy-2-propyl ester) used in the case of preparing the emulsified dispersion of the color developer in the Example, Color developer (b) was used; with maintaining other conditions the same as in the Example, a test was carried out. As a result, the emulsified dispersion showed partial crystallization, and when mixed and stirred with the capsule liquid, was partially colored, so that when it was coated on a transparent film, the film became opaque.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material which comprises a support having provided thereon a transparent heat-sensitive layer comprising color former-containing microcapsules and at least one color developer, wherein said at least one color developer contains the following compound.

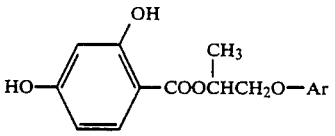

wherein Ar represents a substituted or unsubstituted aryl group.

2. The heat-sensitive recording material as in claim 1, wherein Ar is represented by the formula (II):

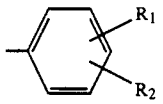

(II)

wherein $R_1$ and $R_2$, which may be the same or different, each represents a hydrogen atom, a halogen atom, an alkyl group, an alkoxy group, an aryl group, an aralkyl group, or an allyl group.

3. The heat-sensitive recording material as in claim 1, wherein said color former is selected from the group consisting of triaryl methane compounds, diphenyl methane compounds, xanthene compounds, thiazine compounds and spiropyrane compounds.

4. The heat-sensitive recording material as in claim 1, wherein said color former is represented by the formula (III):

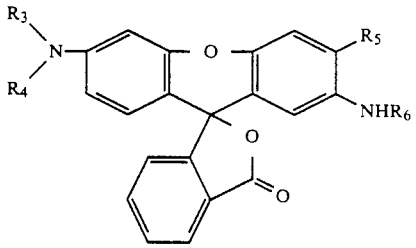

(III)

wherein $R_3$ represents an alkyl group having 1 to 8 carbon atoms, $R_4$ represents an alkyl or alkoxyalkyl group having 4 to 18 carbon atoms, or a tetrahydrofurfuryl group, $R_5$ represents a hydrogen atom, an alkyl group having 1 to 15 carbon atoms, or a halogen atom, and $R_6$ represents a substituted or unsubstituted aryl group having 6 to 20 carbon atoms.

5. The heat-sensitive recording material as in claim 1, wherein said microcapsules are formed of at least one wall-forming material selected from the group consisting of polyurethanes, polyureas, polyesters, polycarbonates, urea-formaldehyde resins, melamine resins, polystyrenes, styrene-methacrylate copolymers, styreneacrylate copolymers, gelatins, polyvinyl pyrrolidones and polyvinyl alcohols.

6. The heat-sensitive recording material as in claim 1, wherein said color developer further contains a compound selected from the group consisting of phenol, compounds, triphenyl methane compounds, carboxylic acid compounds, sulfone compounds, ureas and thiourea compounds.

7. The heat-sensitive recording material as in claim 1, wherein said color developer further contains a compound selected from the group consisting of the following formulae (VII), (VIII), (IX) and (X):

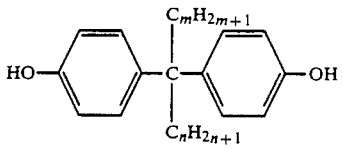

(VII)

wherein m is an integer of from 0 to 2, and n is an integer of from 2 to 11;

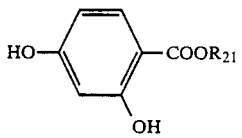

(VIII)

wherein $R_{21}$ represents an alkyl group, an aryl group or an aralkyl group;

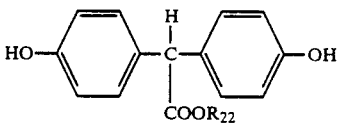

(IX)

wherein $R_{22}$ is an alkyl group;

(X)

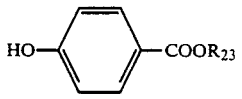

wherein $R_{23}$ is an alkyl group or an aralkyl group.

8. The heat-sensitive recording material as in claim 1, wherein said heat-sensitive layer contains a water-soluble high molecular weight protective colloid.

9. The heat-sensitive recording material as in claim 8, wherein said protective colloid comprises a partially saponified product of a polyvinyl alcohol.

10. The heat-sensitive recording material as in claim 9, wherein the saponification degree of said polyvinyl alcohol is 75 to 90%.

11. The heat-sensitive recording material as in claim 10, wherein said color developer is emulsified in the presence of said partially saponified product of polyvinyl alcohol.

12. The heat-sensitive recording material as in claim 1, wherein Ar is a phenyl group.

* * * * *